United States Patent [19]

Ritter

[11] Patent Number: 4,753,366

[45] Date of Patent: Jun. 28, 1988

[54] PACKAGE FOR CONFECTION COATED FRUIT, SPECIFICALLY, APPLES

[76] Inventor: Russell H. Ritter, 11277 S. 23rd St., Vicksburg, Mich. 49097

[21] Appl. No.: 138,097

[22] Filed: Dec. 28, 1987

[51] Int. Cl.[4] ..... B65D 77/00

[52] U.S. Cl. ..... 220/339; 220/4 B; 206/493; 229/2.5 R

[58] Field of Search ..... 220/339, 306, 265, 254, 220/89 A, 4 B, 4 E; 229/2.5 R; 206/493, 822, 525

[56] References Cited

U.S. PATENT DOCUMENTS

| | | | |
|---|---|---|---|
| 2,918,204 | 12/1959 | Butterfield | 229/2.5 |
| 3,307,746 | 3/1967 | Edwards | 220/265 X |
| 3,934,723 | 1/1976 | Walker | 229/2.5 R X |
| 4,183,446 | 1/1980 | Davis | 229/2.5 R X |
| 4,494,650 | 1/1985 | Cullen | 220/4 B X |
| 4,605,127 | 8/1986 | Magnussen, Jr. | 206/493 X |

*Primary Examiner*—Steven M. Pollard
*Attorney, Agent, or Firm*—Austin A. Webb

[57] ABSTRACT

A container for coated fruit having top and bottom walls connected to coacting side and end walls defining an enclosure for an individual fruit. The top and bottom walls each having inwardly projecting protrusions molded therein and surrounded by break-out lines. The protrusions sized to project into the natural recesses in the ends of the fruit and when detached by breaking the break-out lines, leaving the protrusions for gripping the fruit.

5 Claims, 1 Drawing Sheet

PACKAGE FOR CONFECTION COATED FRUIT, SPECIFICALLY, APPLES

This invention relates to improvements in a Package For Confection Coated Fruit, Specifically, Apples.

OUTLINE OF INVENTION

An aligned series of separably connected containers of molded material defines boxes each having top and bottom walls connected to coacting side and end walls defining enclosures for individual fruit. The top and bottom walls each have protuberances molded therein and projecting inwardly of the boxes to extend into the natural stem end and blow end of the individual fruit in each box. A frangible or break-away line is formed around each protuberance. The side walls along one side of boxes of the series are connected along a folded hinge connection. The opposite side walls have coacting releasable snap fasteners molded into the edges of the top and bottom portions of the boxes.

DETAILED DESCRIPTION

The drawings, of which there is one sheet, illustrate a preferred form of the invention.

Figure 1:
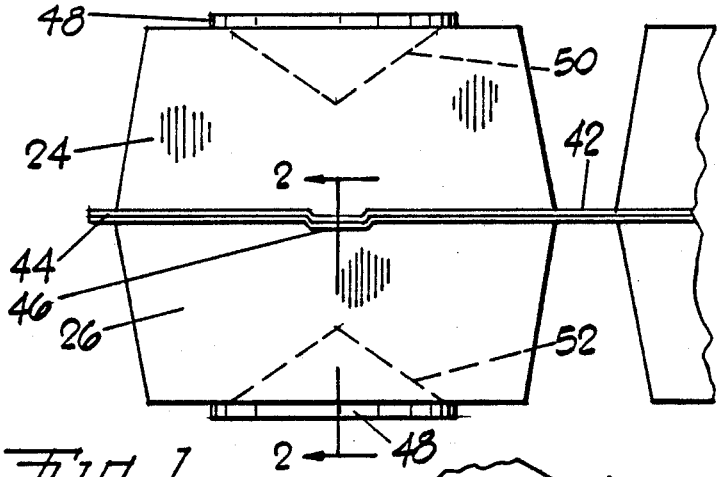
FIG. 1 is a front elevational view of the end container of a series.

Each container has a top wall 20 and a bottom wall 22. Projecting in oppositely diverging relation from the top and bottom walls are upper front walls 24, lower front walls 26, upper side walls 28, lower side walls 30, upper back walls 32 and lower back walls 34. Flanges 36 projecting from the upper and lower back walls are connected along their back edges in integral folding hinge joints 38. Flanges 40 projecting from the side walls are connected to adjacent side flange in a series of containers by frangible or break-away connections indicated at 42. Front flanges 44 have coacting off-set snap connector portions 46.

In the centers of the top and bottom walls are molded outwardly circular ribs 48. Within the circular ribs, the material of the top and bottom walls is deformed or molded into conical protrusions 50 and 52 which projects, respectively downwardly and upwardly, into the upper and lower portions of the container. These protrusions are sized to project into the natural recesses in the stem end and the blow end of apples which are loaded into the containers after receiving a coating of a confection. The conical peaks of the projections are stiffened by radially extending and triangular ribs 54 molded into the material.

Figure 3:
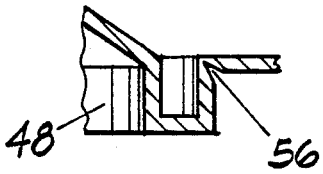
FIG. 3 is a further enlarged fragmentary cross sectional view of the juncture between the protuberances formed in the top and bottom of the container.
Figure 2:
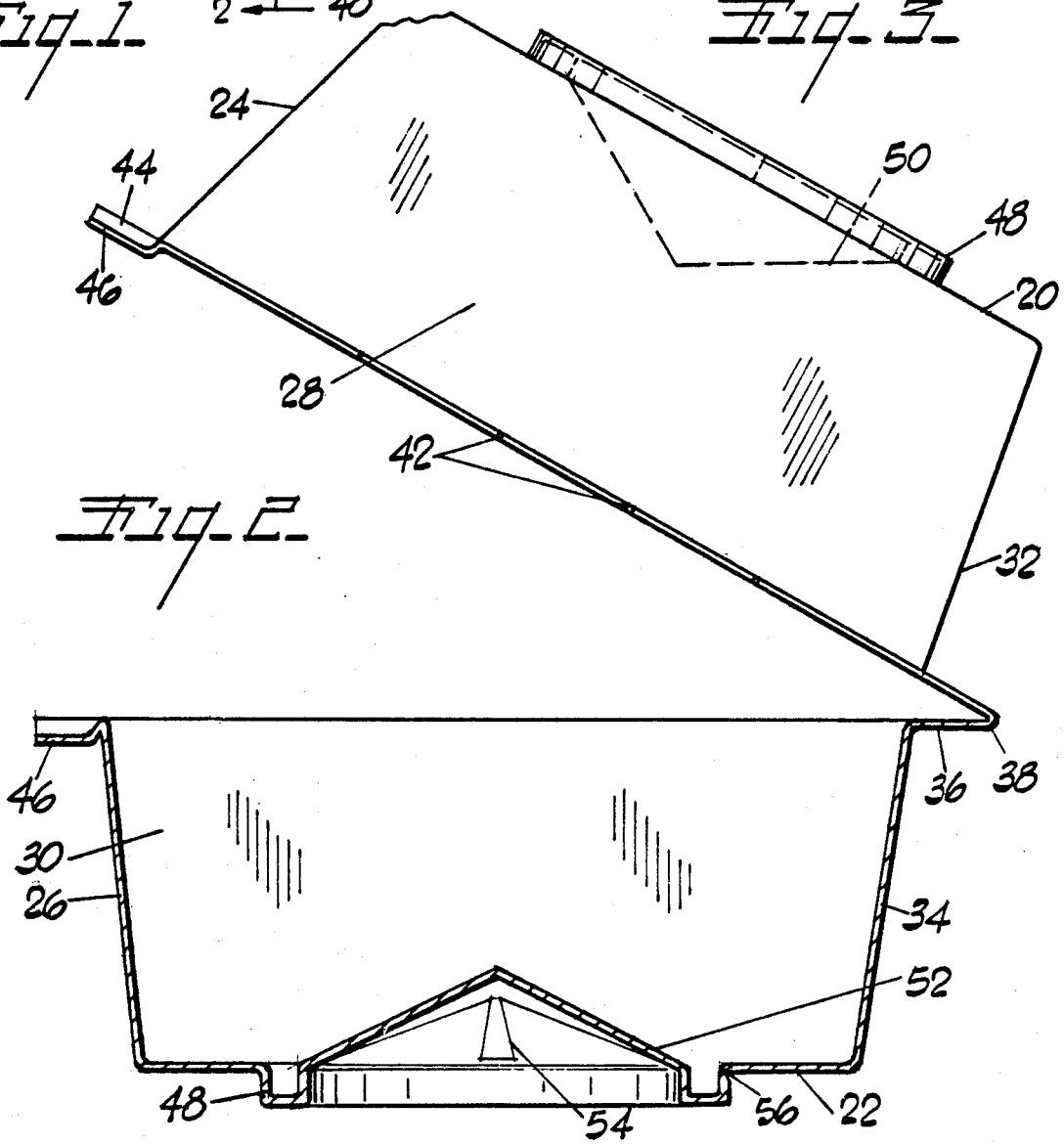
FIG. 2 is an enlarged side elevational view of the container shown in FIG. 1 with the lower portion broken away along the section line 2—2 in FIG. 1, and with the top portion shown in partially open position

As is shown more clearly in FIG. 3 the material which forms the top and bottom walls is molded to shape a circular groove completely around the ribs 48.

The grooves 56 extend sufficiently into the thickness of the molded material to form a weakened or frangible breakaway line in the top and bottom walls.

The action of the containers is simple. The purchaser of a caramel coated apple in a closed container grasps the container with the thumb in either one of the inward protrusions 50 or 52 and with one or more fingers in the opposite one. With the other hand the customer releases the snap fastener 46, or other temporary closure of the flanges 44, and presses the upper and lower portions of the container backwardly over the gripping thumb and finger, thus breaking the circular break-out lines 56 and permitting the top and bottom parts of the containers to be spread back over the gripping fingers. This leaves the two circular protrusions 50 and 52 exposed to be gripped by the other hand, while the empty container is disposed of.

While the symmetrical shape of the upper and lower halves of the container is believed most desirable, it is pointed out this is not necessary; and that similar action could be obtained with a top, or bottom, section that was shallower than the other.

It is pointed out that the protrusions 50 and 52 do not puncture the skin of the enclosed fruit. Thus there is no place to start decay and the shelf life of the packaged fruit is prolonged.

What is believed to be new and what is desired to be secured by Letters Patent is defined in the following Claims.

I claim:

1. A container for coated fruit comprising, a top part, a bottom part, side walls connected around one of said parts and having flanges coacting with the periphery of the other part to define an enclosure, and protrusions formed centrally of said top and bottom parts and projecting inwardly of the container in spaced relation to each other, the peripheries of said protrusions being joined to their respective top and bottom parts along weakened break-out lines, said protrusions sized to project into the natural recesses in the ends of the fruit and when detached by breaking the break-out lines, leaving the protrusions for gripping the fruit.

2. A container as defined in claim 1 in which the opposed edges of said parts are joined in an integral folded hinge along one side of the container.

3. A container as defined in claim 2 in which each of said top and bottom parts has side walls projecting toward the other part, and the side walls of each part have flanges opposed to each other.

4. A container as defined in claim 3 in which the two parts of said container are symmetrically equal and opposed.

5. A series of containers as defined in claim 4 in which the adjacent sides of said container parts are connected along frangible lines in the flanges of the parts.

* * * * *